United States Patent [19]

Goksel

[11] Patent Number: 4,528,029

[45] Date of Patent: Jul. 9, 1985

[54] SELF-REDUCING IRON OXIDE AGGLOMERATES

[75] Inventor: Mehmet A. Goksel, Houghton, Mich.

[73] Assignee: Board of Control of Michigan Technological University, Houghton, Mich.

[21] Appl. No.: 580,828

[22] Filed: Feb. 16, 1983

Related U.S. Application Data

[63] Continuation of Ser. No. 170,643, Jul. 21, 1980, abandoned.

[51] Int. Cl.[3] ..... C22B 1/14

[52] U.S. Cl. ..... 75/3; 23/313 R

[58] Field of Search ..... 23/313 R, 314; 75/3-5, 75/25, 1 R

[56] References Cited

U.S. PATENT DOCUMENTS 3,770,416 11/1973 Goksel ..... 75/3

3,993,471 11/1976 Yoshmura et al. ..... 75/3

4,179,283 12/1979 Rehder ..... 75/3

4,181,520 1/1980 Reuter et al. ..... 75/3

*Primary Examiner*—Barry S. Richman

*Assistant Examiner*—John Donofrio

[57] ABSTRACT

Self-reducing agglomerates of an iron oxide-containing material, such as an iron ore concentrate, having a compressive strength of at least about 100 lbs. are produced by preparing a moistened mixture of the ore concentrate, a finely-divided natural pyrolyzed carbonaceous material having a volatile matter (on dry basis) content of about 20 weight % or less in an amount at least sufficient to reduce all the iron oxide to metallic iron, about 1 to about 30 weight % of a bonding agent, such as burned or hydrated lime, and 0 up to about 3 weight % of a siliceous material (as $SiO_2$), such as silica; forming green agglomerates from this mixture; and hydrothermally hardening the green agglomerates by contacting them with steam under pressure.

8 Claims, No Drawings

SELF-REDUCING IRON OXIDE AGGLOMERATES

CROSS REFERENCE TO RELATED APPLICATIONS

This is a continuation of application Ser. No. 170,643 filed July 21, 1980 now abandoned.

FIELD OF THE INVENTION

This invention relates to a process for producing high-strength agglomerates from finely-divided, iron oxide-containing materials and containing a sufficient amount of internal carbon to reduce all the iron oxide therein to metallic iron.

PRIOR ART

It is known to form finely-divided, iron oxide-containing materials, such as iron ore concentrates and steel plant waste dusts, into pellets containing internal carbon for the purpose of accelerating the rate of reduction of the iron oxide metallic iron when the pellets are charged to a steel making furnace. Such processes are exemplified in U.S. Pat. Nos. 2,793,109 (Huebler et al), 2,806,779 (Case) 3,264,092 (Ban) 3,333,951 (Ban), 3,386,816 (English), 3,770,416 (Goksel) and 3,938,987 (Ban) and Canadian Pat. No. 844,592 (Volin et al).

It is generally recognized that the presence of a carbonaceous material in an amount sufficient to reduce all the iron oxide to metallic iron tends to adversely affect crush resistance or compressive strength of the pellets. In this regard, the Case U.S. Pat. No. 2,806,779 and the Ban U.S. Pat. No. 3,264,092 teach the use of an agglomerating type coal and then heating the pellets to a temperature of about 1600°–2300° F. to destructively distill the coal and thereby produce a char bond for the pellets. The Ban U.S. Pat. No. 3,938,987 teaches that, when non-agglomerating coals, such as lignite, sub-bituminous coals, anthracite coal and coke breeze, are used as the carbonaceous material, the amount must be about 40–80% of that required to reduce iron oxide to metallic iron in order to produce pellets having adequate strength for use in a steel making furnace. The English U.S. Pat. No. 3,386,816 teaches that pellets containing as little as 8% coke have a compressive strength of 58 lbs. which is generally considered unacceptably low for use in most steel making processes.

SUMMARY OF THE INVENTION

The principal object of the invention is to provide a low cost process for forming finely-divided, iron oxide-containing materials into hardened agglomerates containing an amount of carbonaceous material at least sufficient to reduce all the iron oxide to metallic iron and yet having high compressive strengths.

Another object of the invention is to provide a process for producing such agglomerates which are suitable as a charge of steel making furnaces.

Other aspects, advantages and objects of the invention will become apparent to those skilled in the art upon reviewing the following detailed description and the appended claims.

In accordance with the invention, hardened agglomerates having a compressive strength of at least about 100 lbs. and containing a major portion of iron oxide and a sufficient amount of a carbonaceous material to reduce all the iron oxide to metallic iron are produced by utilizing a natural or pyrolyzed carbonaceous material having a volatile matter (on dry basis) content of about 20 weight % or less, such as bituminous coal char, anthracite coal, lignite char, coke, wood char, and graphite and the like. Hydrothermally hardened, iron oxide agglomerates containing carbonaceous materials, having a high volatile matter content, in an amount sufficient to reduce all the iron oxide to metallic iron exhibit crush resistance or compressive strengths which are unacceptably low for many uses. Quite unexpectedly, it has been found that the compressive strengths of such agglomerates can be increased significantly by using a natural or pyrolyzed carbonaceous materials having a volatile matter (on dry basis) content of about 20 weight % or less.

More specifically, the process of invention includes the steps of preparing a moistened mixture of a finely divided iron oxide-containing material, a finely-divided, natural or pryolyzed carbonaceous material having a volatile matter (on dry basis) content of about 20 weight % or less in an amount at least sufficient to reduce all the iron oxide to metallic iron, about 1 to about 30 weight % of a bonding agent selected from a group consisting of oxides, hydroxides and carbonates of calcium and magnesium and mixtures thereof, and 0 to about 3 weight % of a siliceous material (as available $SiO_2$); forming the resulting mixture into discrete green agglomerates; and hydrothermally hardening the green agglomerates by contacting them with steam for a time period sufficient to form them into hardened, integral bonded masses.

DESCRIPTION OF THE PREFERRED EMBODIMENTS

The process can be used to produce hardened agglomerates from iron ore concentrates and so-called "steel plant waste oxides", or iron-rich (e.g., 30–80% iron) solid particulates or fines recovered as by-products from steel making processes, including dust collected from the fumes of BOF, open hearth, blast, and electric furnaces, mill scale fines, grit chamber dusts, fines separated from pelletized iron ore, etc. As used herein, the term "iron oxide-containing material" encompasses iron ore concentrates, steel plant waste oxides or mixtures thereof. The process is particularly suitable for producing high strength agglomerates from iron ores, such as hematite and magnetite, preferably in the form of high purity ores or concentrates containing about 45–70% iron and the balance gangue and oxide. Accordingly, the process will be described with an iron ore concentrate being used as a starting material.

A starting mixture is first prepared by thoroughly blending together an iron ore concentrate, a carbonaceous material, a bonding agent, a siliceous material and a sufficient amount of water to form a moistened mixture capable of being formed into discrete agglomerated masses or pellets.

The carbonaceous material can be either naturally occuring or pyrolyzed so long as it has a volatile matter (on dry basis) content of about 20 weight % or less, preferably about 10 weight % or less. Pyrolyzed carbonaceous materials generally are preferred because of their lower volatile content.

Representative suitable natural carbonaeous materials include low volatile anthracite coal, graphite and the like.

The term "pyrolyzed carbonaceous material" as used herein means a solid product produced by heating a naturally occurring, high carbonaceous material to elevated temperatures in the absence of oxygen to drive off a substantial portion of the volatile matter, primarily organic matter. Representative suitable pyrolyzed carbonaceous materials include chars produced from non-coking bituminous, subbituminous and anthracite coals, lignite char, wood char, coke produced from bituminous coal, coke breeze, petroleum and coal tar pitch, and mixtures thereof. Of these, butuminous coal char, lignite char and coke breeze are preferred because of their lower cost.

Suitable bonding agents include the oxides, hydroxides, and carbonates of calcium and magnesium and mixtures thereof. Burned lime (CaO) and hydrated lime ($Ca(OH)_2$) are preferred because, in addition to functioning as a bonding agent, they can assist in slag formation and sulfur removal when the agglomerates are used in a steel making process.

The amount of bonding agents used is about 0.1 to about 30 weight %, based on the total weight of the dry solids in the starting mixture. When less than about 0.1 weight % is used, the hardened pellets do not have sufficient crush resistance or compressive strength to withstand the loads normally imposed thereon during handling, storage and transportation. On the other hand, amounts of the bonding agents in excess of about 30 weight % do not appreciably increase the compressive strengths, can dilute the concentration of iron oxide in the final agglomerates to an undesirable level and can cause formation of excessive amounts of slag during melting. The preferred amount of bonding agent is about 2 to about 10 weight %.

If the iron oxide-containing material contains an appreciable amount (e.g., about 0.5 weight % or more) of available $SiO_2$ capable of reacting with the bonding agent to formed silicate or hydrosilicate bonds therewith during the conditions of hydrothermal hardening, hardened pellets having compressive strengths up to about 200 lbs. can be obtained without adding a siliceous material to the starting mixture. For higher purity iron ore concentrates containing relatively small amounts of available $SiO_2$, an amount of natural or artificial siliceous material containing up to 3 weight % available $SiO_2$, based on the total weight of the dry solids, is added to the starting mixture. The total available $SiO_2$ in the mixture, whether as part of the iron oxide containing material or added with the siliceous material, should be at least 0.5 weight %.

Representative suitable siliceous materials include finely ground quartz, silica sand, bentonite, diatomaceous earth, fuller's earth, sodium, calcium magnesium, and aluminum silicates, pyrogenic silica, various hydrated silicas and mixtures thereof. Of these, finely ground quartz and silica sand are preferred.

In addition to the bonding agent and the siliceous material, other strengthening additive can be included in a starting mixture to further increase the strength of the hardened agglomerates. For examples, oxides, hydroxides, carbonates, bicarbonates, sulfates, bisulfate, and borates of alkali metals (e.g. potassium and sodium) and mixtures thereof can be added in amounts ranging to about 3 weight %. Of these, sodium hydroxide, sodium carbonate, and sodium bicarbonate are preferred. The presence of some of these strengthening additives might be considered undesirable when the hardened agglomerates are used as a charge for blast furnaces. In those cases, such additives can be omitted without significantly reducing the strength of the agglomerates. When used, the preferred amount of the strengthening additives is about 0.15 to about 1 weight %.

The amount of water included in the starting mixture varies, depending on the physical properties of the materials and the particular agglomeration technique employed. For example, when a pelletizing process employing a balling drum or disc is used for form spherical pellets, the total amount of water in the moistened starting mixture generally should be about 5 to about 20 weight %, preferably about 10 to about 15 weight %. On the other hand, when a briquetting press is used, the amount of water in the moistened starting moisture generally should be about 3 to about 15 weight %, preferably from about 5 to about 10 weight %.

The average particle size of the various solid materials included in the starting mixture generally can range from about 10 to about 325 mesh with all preferably being less than about 200 mesh. Particle sizes coarser than about 100 mesh make it difficult to obtain a homogeneous mixture of the constituents and, in some cases, produce insufficient surface area to obtain the requisite high strength bond in the hardened agglomerates. Also, it is difficult to form pellets from mixtures containing coarser pellets. Preferably, at least half of all solid materials in the starting mixture have an average particle size less than about 200 mesh for pelletizing. Briquettes can be produced with coarser particles.

Many low volatile, naturally occurring and pyrolyzed carbonaceous materials have small capillary-like pores or cavities which tend to absorb water during the mixing step. This free internal moisture tends to be converted to steam during the hydrothermal hardening step, causing a reduction in the compressive strength and sometimes cracking or bursting when excessive amounts are present in the pores or cavities. This can be minimized by allowing the moistened mixture to rest or stand a sufficient time for a substantial portion of the free internal moisture in the carbonaceous material to migrate from the pores or cavities to the surface.

The time and conditions for this holding or standing step can vary considerably depending primarily on the particular type of carbonaceous material and bonding agent being used. Removal of excess internal moisture from the pores or cavities in the carbonaceous material can be accelerated by heating the moistened mixture to an elevated temperature. When burned lime and/or magnesium oxide is used as the bonding agent, they react with the moisture present to form hydrates. This exothermic hydration reaction tends to accelerate migration of the free internal moisture to the particle surface, resulting in a shortening of the standing time required without external heating.

As a general guide, the moistened mixture, prior to agglomeration, is allowed to stand for about 0.5 to about 48 hours, preferably about 2 to about 3 hours, at a temperature of about 60° to about 90° C. Higher temperatures and pressures can be used, but are less desirable because of the higher operational costs. When burned lime or magnesium oxide is used as the bonding agent, the moistened mixture preferably is placed in a closed, thermally insulated container to take advantage of the exothermic hydration reaction.

The moistened mixture is next formed into green agglomeration of the desired size and shape for the intended end use by a conventional agglomeration technique, such as molding, briquetting, pelletizing, extruding and the like. Pelletizing with a balling disc or drum is preferred because of the lower operating costs.

When in the form of spherical pellets, the green agglomerates generally have a diameter of about 5 to about 25 mm, preferably about 10 to about 20 mm. When briquetting is used, the agglomerates preferably are in a spherical-like or egg shape and have a major diameter ranging up to about 75 mm. Larger pellets and briquettes can be used if desired.

The crush resistance or compressive strength of the hardened agglomerates can be increased by drying the green agglomerates to a free moisture content of about 5 weight % or less, preferably about 3 weight % or less, prior to the hydrothermal hardening step. This drying can be accomplished by conventional means, such as by placing the green agglomerates in an oven or by blowing a heated gas thereover, using drying temperatures up to the decomposition temperature of the carbonaceous material. The time required to reduce the free moisture content to about 5 weight % or less depends upon the drying temperatures used, the moisture content of the green agglomerates, flow rate of the drying gas, the level to which the moisture content is reduced, size and shape of the green agglomerates, etc.

The green agglomerates are introduced into a reaction chamber or pressure vessel, such as an autoclave, wherein they are heated to an elevated temperature in the presence of moisture to effect a hardening and bonding of the individual particle into an integral, high strength mass. The compressive strength of the hardened agglomerates produced by this hydrothermal hardening step depends to some extent upon the temperature, time, and moisture content of the atmosphere use.

The application of heat to the green agglomerates can be achieved by any one of a number of methods. The use of steam is preferred because it simultaneously provides a source of heat and moisture necessary for the hydrothermal reaction. Either saturated steam or substantially saturated steam be used. Superheated steam tends to produce hardened agglomerates having reduced strengths. Therefore, steam at temperatures and pressures at or close to that of saturated steam is preferred. Temperatures generally ranging from about 100° to about 250° C., preferably 200° to about 225° C., can be satisfactorily employed to achieve the desired hardening of the green agglomerates within a reasonable time period.

Autoclaving pressures substantially above atmospheric pressure are preferred in order to decrease the hardening time and to improve the strength of the hardened agglomerates. Generally, economic conditions dictate that the maximum pressure should not exceed about 35 atmospheres and a pressure of about 10 to about 25 atmospheres is preferred.

The retention time of the pellets in the reaction chamber or pressure vessel depends upon several process variables, such as pressure, temperature, and atmosphere of the chamber, size and composition of the pellets, etc. In any case, this time should be sufficient for the bonding agent to form silicate and/or hydrosilicate bonds in the available $SiO_2$ and bond the individual particles into a hardened, high strength condition. When higher temperatures and pressures are used, the time for the hydrothermal hardening generally is about 5 minutes to about 15 hours, preferably about 30 to about 60 minutes.

The hardened agglomerates are removed from the reacting chamber and, upon cooling, are ready for use. The hot, hardened agglomerates usually contain up to about 1.5% free moisture and have compressive strength characteristics suitable for most uses. The compressive strength of the hardened agglomerates can be increased by rapidly drying them, preferably immediately after removal from the reaction chamber and before appreciable cooling as occurred, to remove substantially all of the free moisture therefrom. This drying can be accomplished in a convenient manner.

The minimum compressive strength of hardened agglomerates produced by the process of the invention varies depending on the size of the agglomerate. For example, spherical pellets with a diameter of 12–15 mm have a compressive strength of at least 100 lbs. and those with a diameter of about 30 mm have a compressive strength in the neighborhood of about 200 lbs. or more.

Without further elaboration, it is believed that one skilled in the art, using the preceding description, can utilize the invention of its fullest extent.

The following example is presented to illustrate the invention and should not be construed as a limitation thereto.

EXAMPLE

A series of tests was run to evaluate the crush resistance or compressive strength of hardened magnetite pellets containing different types of carbonaceous materials in amounts sufficient to reduce all the iron oxide to metallic iron. The ingredients making up the starting mixture were blended together in a roller or intensive mixer for a sufficient time to obtain a uniformly moistened blend. Green, spherically-shaped pellets (15 mm) were prepared from the mixtures in a conventional balling device. The green pellets were dried to a moisture content of about 0–3 weight % and then placed in a high pressure steam autoclave. The autoclave was heated and maintained at a temperature of 210° C. and a pressure of 22 atm for one hour. After cooling, the compressive strength of the pellets was measured with a Dillon tester. Results from these tests are summarized in Table I.

COMPRESSIVE STRENGTHS OF MAGNETITE PELLETS CONTAINING DIFFERENT CARBONACEOUS MATERIALS COMPOSITION, WT % OF DRY SOLIDS

| | | | | CARBONACEOUS MATERIAL | | |
|---|---|---|---|---|---|---|
| Magnetite | CaO | $Na_2CO_3$ | $SiO_2$ | Type | Amount | Compressive Strength, lbs |
| 77 | 7 | 0.15 | 0.85 | Bit. Coal Char | 15 | 230 |
| 72 | 7 | 0 | 1[a] | Bituminous Coal | 20 | 78 |
| 75.35 | 7 | 0.15 | 0.45 | Bit. Coal Char | 17 | 183 |
| 82.42 | 2 | 0.15 | 0.425 | Lignite | 15 | 2.6 |
| 82.42 | 2 | 0.15 | 0.425 | Lignite Char | 15 | 117.5 |
| 77 | 7 | 0.15 | 0.85 | Coke Fines | 15 | 218 |

-continued

COMPRESSIVE STRENGTHS OF MAGNETITE PELLETS CONTAINING DIFFERENT CARBONACEOUS MATERIALS COMPOSITION, WT % OF DRY SOLIDS

| | | | | CARBONACEOUS MATERIAL | | |
|---|---|---|---|---|---|---|
| Magnetite | CaO | $Na_2CO_3$ | $SiO_2$ | Type | Amount | Compressive Strength, lbs |
| 88 | 7 | 0 | 0 | Anthracite Coal | 15 | 203 |

[a]Dicalite, a diatomaceous earth supplied by General Refractory

From these results, it can be seen that pellets containing a carbonaceous material having a low volatile matter content (anthracite) or which was pyrolyzed (bituminous coal char, lignite char and coke), had compressive strengths in excess of 100 lbs. On the other hand, pellets containing a carbonaceous material having a high volatile matter content (bituminous coal and lignite) had substantially lower compressive strengths. The use of chars from non-coking bituminous coal, lignite and other low grade carbonaceous materials is particularly advantageous because of the low cost of these materials and the volatiles driven off during the pyrolyzing process can be burned and used as a heat source.

From the foregoing description, one skilled in the art can easily ascertain the essential characteristics of the invention and, without departing from the spirit and scope thereof, can make various changes and modifications to adapt the invention to various usages and conditions.

I claim:

1. A process for producing self-reducing agglomerates from a finely-divided, iron ore concentrate and having a compressive strength of at least 100 lbs. comprising the consecutive steps of:

(a) preparing a moistened starting mixture including the iron ore concentrate, a finely-divided natural or pyrolyzed carbonaceous material having a volatile matter (on dry basis) content of about 20 weight % or less in an amount at least sufficient to reduce all the iron oxide to metallic iron, about 1 to about 30 weight % of a finely-divided bonding agent selected from a group consisting of the oxide, hydroxides, and carbonates of calcium and magnesium, and mixtures thereof, and 0 up to about 3 weight % of a finely-divided siliceous material, as available $SiO_2$ capable of reacting with said bonding agent to form silicate or hydrosilicate bonds therwith with the total available $SiO_2$ in said mixture being at least 0.5 weight % the weight percentages based upon the total weight of the dry solids in said mixtures;

(b) allowing said mixture to stand for about 0.5 to about 48 hours at a temperature of about 60° to about 90° C. to promote the migration of a substantial portion of the free internal moisture in the pores of said carbonaceous material to the surface of said carbonaceous material;

(c) forming discrete, green agglomerates from said starting mixture;

(d) drying said green agglomerates to a moisture content of about 5 weight % or less; and (e) hydrothermally hardening said green aglomerates by contacting them with steam at a temperature of about 100° to 250° C. for a time period sufficient for said bonding agent to form silicate or hydrosilicate bonds with the available $SiO_2$ and produce hardened and integrally bonded masses.

2. A process according to claim 1 wherein said bonding agent is calcium oxide or calcium hydroxide.

3. A process according to claim 2 wherein said siliceous material is silica.

4. A process according to claim 1 wherein said carbonaceous material is selected from the group consisting of bituminous coal char, anthracite coal, lignite char, wood char, coke, graphite and mixtures thereof.

5. A process according to claim 4 wherein said carbonaceous material is bituminous coal char, lignite char or mixtures thereof.

6. A process according to claim 4 wherein the volatile matter content of said carbonaceous material is about 10 weight % or less.

7. A process according to claim 4 wherein said moistened mixture includes up to about 3 weight %, based on the total weight of the dry solids in said mixture, of a strengthening additive selected from the group consisting of the oxides, hydroxides, carbonates, bicarbonates, sulfates, bisulfates, and borates of the alkali metals, quanternary ammonium hydroxides, quanternay ammonioum chlorides, quanternary ammonium amines, and mixtures thereof.

8. A process according to claim 7 wherein said strengthening additive is selected from the group consisting of sodium hydroxide, sodium carbonate, and sodium bicarbonate.

* * * * *